US005411399A

United States Patent [19]

Okuyama et al.

[11] Patent Number: 5,411,399

[45] Date of Patent: May 2, 1995

[54] CIRCUIT BOARD CONNECTOR

[75] Inventors: Hideki Okuyama, Kariya; Masahiro Yamamoto, Yokohama; Toshimitsu Sonobe, Tokyo, all of Japan

[73] Assignee: Thomas & Betts Corporation, Memphis, Tenn.

[21] Appl. No.: 16,332

[22] Filed: Feb. 11, 1993

[30] Foreign Application Priority Data

Feb. 13, 1992 [JP] Japan ..... 4-026715

[51] Int. Cl.[6] ..... H01R 9/09

[52] U.S. Cl. ..... 439/67; 439/77; 439/595

[58] Field of Search ..... 439/44–48, 439/67, 77, 61, 62, 372, 595, 599

[56] References Cited

U.S. PATENT DOCUMENTS

| | | | |
|---|---|---|---|
| 3,212,049 | 10/1965 | Mittler et al. | 439/45 |
| 3,696,319 | 10/1972 | Olsson | 439/67 |
| 3,795,885 | 3/1974 | Desso et al. | 439/67 |
| 4,363,530 | 12/1982 | Verhoeven | 339/17 |
| 4,482,937 | 11/1984 | Berg | 361/413 |
| 4,630,874 | 12/1986 | Renn et al. | 439/67 |
| 4,664,458 | 5/1987 | Worth | 339/17 |
| 4,697,858 | 10/1987 | Balakrishnan | 439/61 |
| 5,021,003 | 6/1991 | Ohtaka et al. | 439/372 |
| 5,035,661 | 7/1991 | Steinhardt et al. | 439/595 |
| 5,051,100 | 9/1991 | Kato et al. | 439/595 |
| 5,105,055 | 4/1992 | Mooney et al. | 174/27 |

*Primary Examiner*—Larry I. Schwartz
*Assistant Examiner*—Hien D. Vu
*Attorney, Agent, or Firm*—Robert M. Rodrick

[57] ABSTRACT

A connector connecting two circuit boards of different types comprises an insulative male housing which houses conductive plug contacts therein, a circuit board having conductive receptacle contacts engaged with the housing and making electrical connection with the plug contacts, and a flexible conductor engaged with the housing and making electrical connection with the plug contacts.

6 Claims, 3 Drawing Sheets

CIRCUIT BOARD CONNECTOR

FIELD OF THE INVENTION

The present invention relates to a connector for connecting a circuit board, and more particularly to a connector for connecting two circuit boards of different types.

BACKGROUND OF THE INVENTION

When a rigid circuit board and a flexible circuit board are to be electrically connected, it is a usual practice to secure them by extending a screw through both circuit boards. To this end, however, it is necessary to form holes through which the screw extends in both circuit boards and to form conductive areas around the holes. Accordingly, a substantial space is required. This has been an obstacle for reducing the size of the device or increasing the integration density.

SUMMARY OF THE INVENTION

It is an object of the present invention to solve the problems encountered in prior art connectors.

It is another object of the present invention to provide a connector which facilitates positive connection when it is applied to an electronic device having a number of electrodes to be connected.

In order to achieve the above objects, the connector of the present invention comprises:

an insulative male housing including therein a plurality of conductive plug contacts;

a substrate having a plurality of conductive receptacles engaged with the male housing and making electrical connection with the plug contacts housed in the housing; and a case member having a conductor engaged with the male housing and making electrical connection with the plug contacts.

DETAILED DESCRIPTION OF PREFERRED EMBODIMENTS

Figure 1:
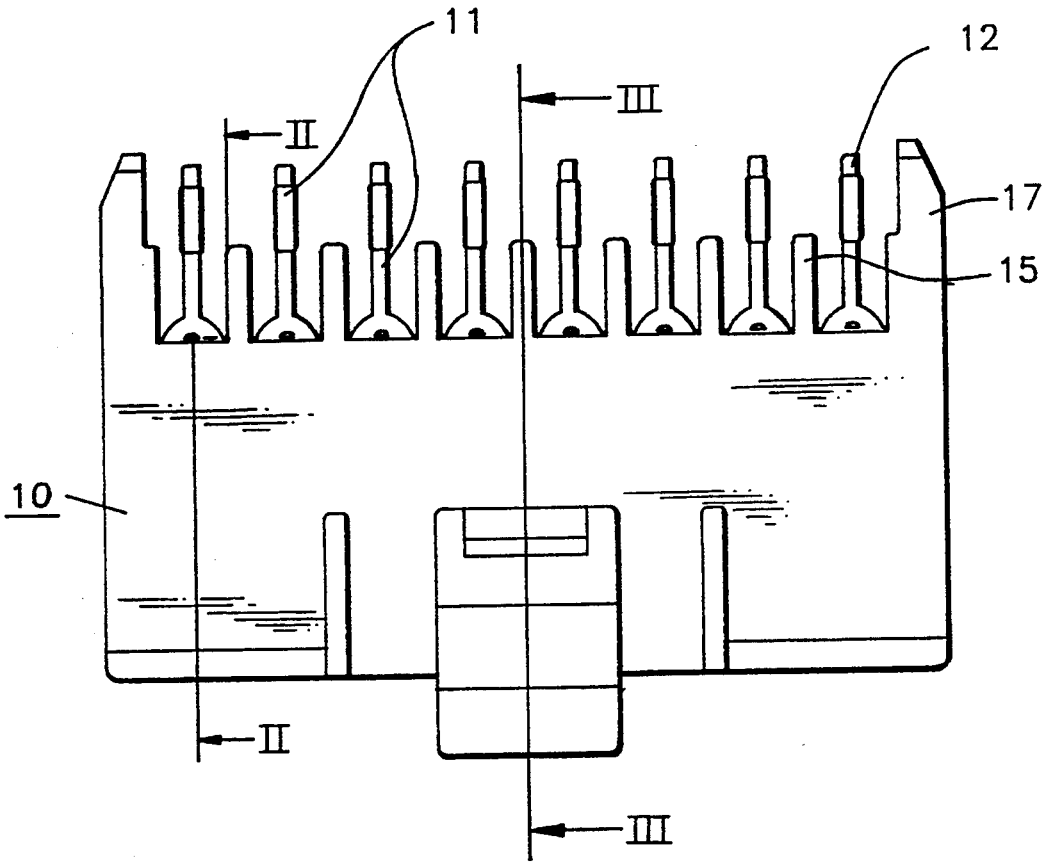
FIG. 1 shows a front view of a male housing of a connector of the present invention.
Figure 2:
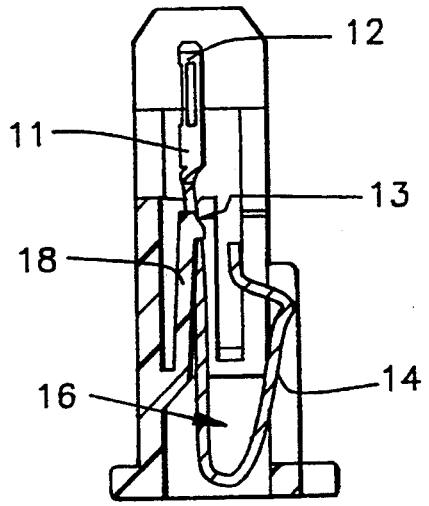
FIG. 2 shows a sectional view of the housing of FIG. 1, along viewing lines A—A.
Figure 3:
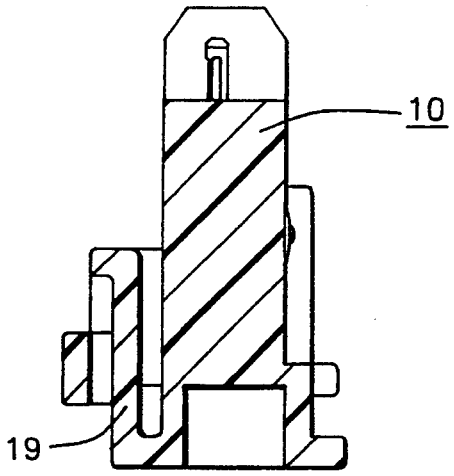
FIG. 3 shows a sectional view of the housing of FIG. 1, along viewing lines B—B.

FIGS. 1 to 3 show a male housing 10 supporting a plurality of plug contacts 11 therein. The present embodiment is an eight-pole connector in which eight plug contacts are housed in a cavity 16 formed longitudinally of the housing. Contacts (first connecting parts to be described later) which project from the cavity are spaced and insulated from each other by a bulkhead 15.

Each of the plug contacts has first and second connecting parts 12 and 14. The first connecting part 12 is a plate-shaped contact which makes electrical connection with a receptacle contact to be described later. The second connecting part 14 is a hook-shaped leaf spring which makes electrical contact to a conductor or an electrode of a circuit board formed on a case member (to be described later) when the case member is engaged with the male housing. The leaf spring has a sufficient return force to assure electrical connection. Each of the plug contacts has a latch 13 to engage with lance-shape latch means 18 formed in the cavity of the housing.

As shown in FIG. 1, guide walls 17 projecting in the same direction as the direction of the plug contacts and formed on the opposite ends of the housing. Walls 17 serve as a guide for aligning the contacts when the male housing is inserted into the circuit board to be connected, as will be described.

Figure 4:
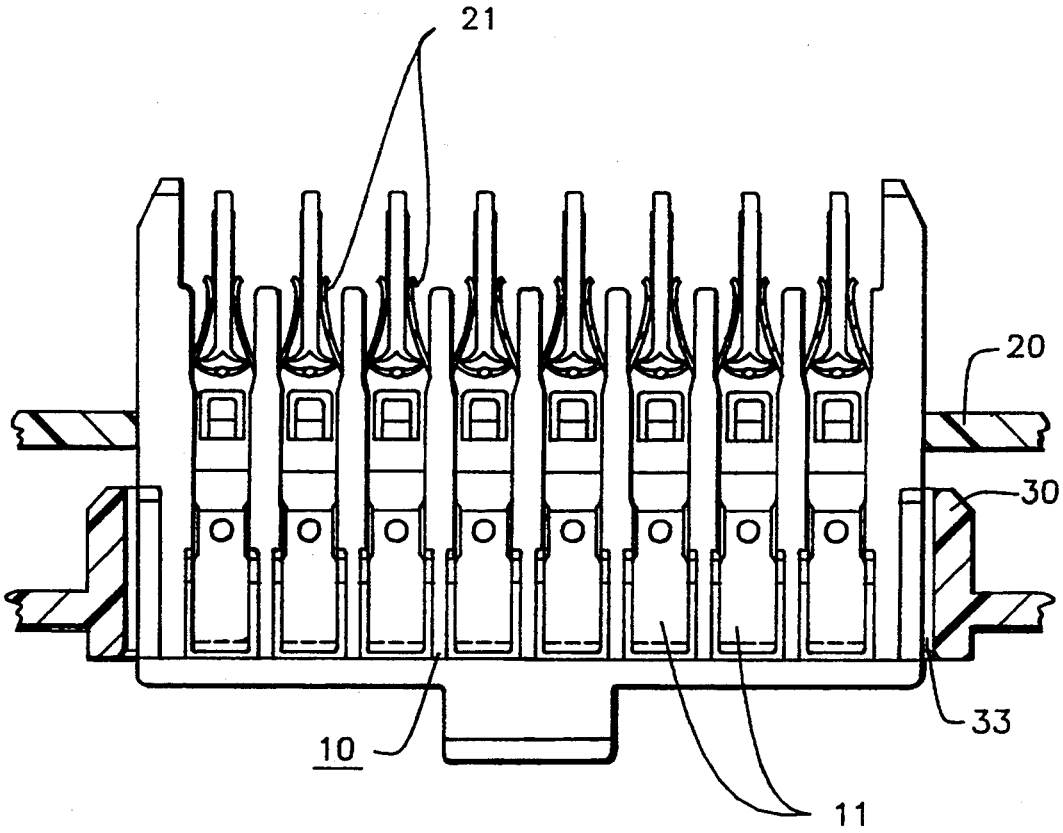
FIG. 4 shows a longitudinal sectional view of the connector of the present invention, as connected to a printed circuit board.
Figure 5:
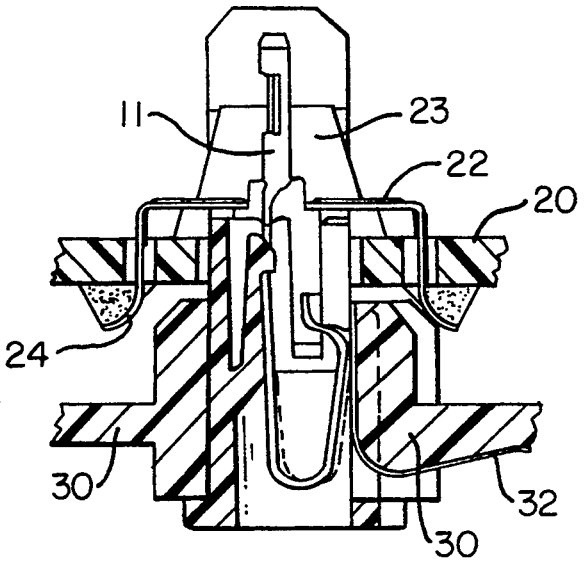
FIG. 5 shows a partial longitudinal sectional view of the connector of the present invention, as connected to printed circuit.
Figure 6:
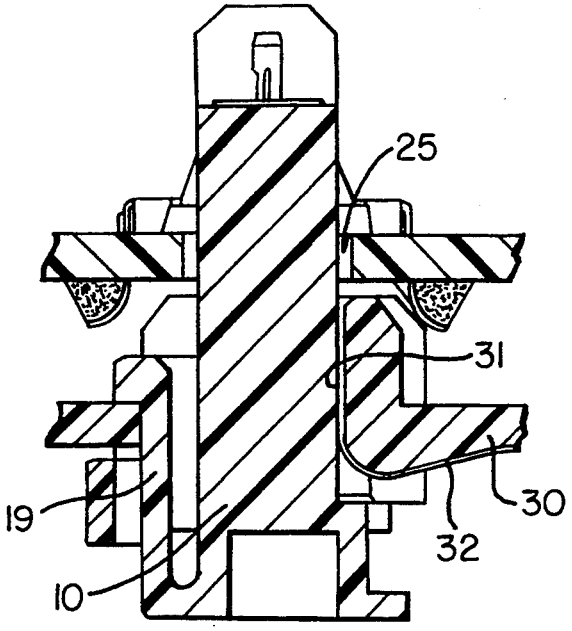
FIG. 6 shows a further partial sectional view of the connector of present invention, as connected to a printed circuit board.

FIGS. 4 to 6 show connection of two circuit boards of different types by the male housing which houses the plug contact therein.

One circuit board 20 is a rigid printed circuit board on which receptacle contacts 21 to be connected with the plug contacts are formed. The other circuit board 32 is a flexible printed circuit board which has a conductor 31 to be electrically connected with the plug contacts. In the present embodiment, the flexible circuit board 32 is arranged on a case member 30 of the male housing.

Figure 7:
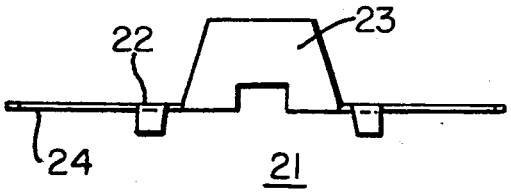
FIG. 7 shows a front view of a receptacle contact of the connector of the present invention.
Figure 8:
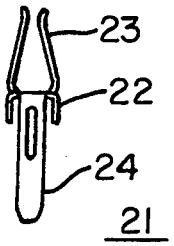
FIG. 8 shows a side elevational view of the receptacle contact of the connector of the present invention.

As shown in detail in FIGS. 7 and 8, the receptacle contact 21 comprises a main part 22, a plate-shaped spring contact 23 projecting upward from the main part and facing the main part, and a leg 24 projecting downward from the main part. (FIG. 7 shows the leg before it is bent).

In FIG. 5, the main part 22 of the receptacle contact is attached to the one circuit board 20 spacedly from the surface thereof. The leg 24 extends through the board and is soldered on a rear surface thereof. As a result, a long distance between the soldering point of the leg and the spring contact is permitted and a problem of deposition of flux flowing to the contact during the soldering is avoided.

The spring contact 23 has a sufficiently wide connecting part compared to the plug contact to be electrically connected therewith.

The circuit board 20 and the case member 30 have holes 25 and 33, respectively, for receiving the housing 10 thereinto. The hole 25 has a larger inner diameter in one of two crossing directions than a corresponding outer diameter of the housing, and the hole 33 has a larger inner diameter in the other of the two crossing directions than a corresponding outer diameter of the housing. In the embodiments shown in FIGS. 4 and 5, the hole 25 of the circuit board 20 has a larger inner diameter in a lateral direction of the housing than a corresponding outer diameter of the housing (see FIG. 5). (There is no such play in a longitudinal direction. See FIG. 4). On the other hand, the hole 33 of the case member 30 has a larger longitudinal inner diameter than a corresponding outer diameter of the housing (see FIG. 4). (There is no such play in the lateral direction of the housing. See FIG. 5).

As shown in FIGS. 4 to 6, the case member 30 engages with the plug housing 10 and covers the plug housing. The plug housing has lance-shaped latch means 19 for engaging with the case member, as shown in FIG. 6.

A sequence to connect the connector of the present invention is now explained. First, the male housing which houses the plug contacts therein is inserted into the hole 33 of the case member 30 to cause the plug contacts 11 to contact the conductor 31 of the case member. Then, the plug housing is further inserted into the hole 25 of the circuit board 20 to make the plug contacts contact the receptacle contacts 21 of the circuit board 20. As shown in FIG. 4, the bulkheads 15 of the housing are inserted between the receptacle contacts to insulate the receptacle contacts.

The timing at which the plug contacts make contact to the conductor and the timing at which the plug contacts make contact to the receptacle contacts are offset as described above, and hence peaks of the force required for the connection are split into two parts. This reduces the insertion force. When the connector is connected, the bulkheads 15 of the housing inserted between the receptacle contacts serve to insulate the receptacle contacts. Accordingly, no means for insulating the receptacle contacts is needed on the circuit board, and the arrangement pitch of the contacts may be reduced accordingly. (In the prior connectors, similar means to the bulkheads 15 of the housing are provided on the circuit board so that they intermesh with each other when they are connected).

In accordance with the connector of the present invention, two circuit boards can be electrically and mechanically connected in an easy and positive manner by merely engaging the male housing which houses the plug contacts therein to the circuit boards. The effect of the present invention is significant when it is applied, for example, to an automobile meter in which the circuit boards of different types are connected. Since no screw is needed as opposed to known connectors, there is no need for a space therefor, and the size of the device can be reduced or the integration density can be improved.

We claim:

1. A connector comprising:

an insulative male housing (10) supporting therein a plurality of conductive plug contacts (11);

a substrate (20) engaged with said male housing, said substrate having a plurality of conductive receptacle contacts (21) making electrical connection with the plug contacts in said housing; and a case member (30) engaged with said male housing, said case member having a conductor (31) making electrical connection with said plug contacts, each of said receptacle contacts (21) comprising a main part (22) attached to said substrate spacedly from a surface thereof, a plate-shaped spring contact (23) projecting upwardly from said main part and pinching said plug contact thereby making connection with said conductor (31), and a leg (24) projecting downward from the main part and soldered on a rear surface of said substrate.

2. A connector according to claim 1 wherein said substrate is a circuit board made of a rigid material and said case member comprises a flexible circuit board (32).

3. A connector according to claim 2 wherein each of said plug contacts (11) comprises a plate-shaped first connecting part (12) electrically connected to said receptacle contact, a latch (13) engaging said housing and a second connecting part (14) electrically connected to said conductor of said case member, and said second connecting part (14) being a hook-shaped leaf spring making contact with said conductor (31) of said case member.

4. A connector according to claim 1 wherein said plug contacts (11) are separated and insulated from each other by a bulkhead (15) provided in said housing.

5. A connector according to claim 2 wherein said circuit board (20) and said case member (30) have holes (25) and (33), respectively, receiving said housing thereinto, said hole (25) having an inner diameter in one direction larger than a corresponding outer diameter of said housing, said hole (33) having an inner diameter in a direction transverse to said one direction larger than a corresponding outer diameter of said housing.

6. A connector comprising:

an insulative male housing (10) supporting therein a plurality of conductive plug contacts (11);

a circuit board of rigid material (20) engaged with said male housing, said circuit board having a plurality of conductive receptacle contacts (21) making electrical connection with the plug contacts in said housing; and a case member (30) engaged with said male housing, said case member comprising a flexible circuit board and including a conductor (31) making electrical connection with said plug contacts, said circuit board (20) and said case member (30) having holes (25) and (33), respectively, receiving said housing thereinto, said hole (25) having an inner dimension in one direction larger than a corresponding outer dimension of said housing, said hole (33) having an inner dimension in a direction transverse to said one direction larger than a corresponding outer dimension of said housing.

* * * * *